United States Patent [19]

Masters et al.

[11] Patent Number: 4,671,346

[45] Date of Patent: Jun. 9, 1987

[54] REGENERATIVE HEATING SYSTEMS

[75] Inventors: Jeffery Masters; Roger J. Webb, both of Solihull, United Kingdom

[73] Assignee: British Gas Corporation, London, England

[21] Appl. No.: 817,452

[22] Filed: Jan. 9, 1986

[30] Foreign Application Priority Data

Feb. 4, 1985 [GB] United Kingdom ..... 8502760

[51] Int. Cl.[4] ..... F28D 17/04

[52] U.S. Cl. ..... 165/9.3; 165/9.4; 432/181

[58] Field of Search ..... 165/9.3, 9.4; 432/180, 432/181, 182

[56] References Cited

U.S. PATENT DOCUMENTS 2,785,212 3/1957 Begley ..... 432/180

FOREIGN PATENT DOCUMENTS 538293 3/1957 Canada ..... 432/181

*Primary Examiner*—Albert W. Davis, Jr.

*Attorney, Agent, or Firm*—Oblon, Fisher, Spivak, McClelland & Maier

[57] ABSTRACT

A regenerative heating system includes at least a pair of regenerators of the type which are operable so that while one is being heated by waste gas the other is heating air for the combustion of fuel. The system includes a pair of regenerators 1 and 2 which are interconnected adjacent one end to form a chamber 4 having an outlet 8 to discharge waste gas flow into the chamber from one or other of the regenerators. Air nozzles 7 extend into the chamber 4 to inject air into the regenerators 1 and 2 during the air heating cycle of regenerator. The waste gas may be removed by the suction force of a fan or eductor.

3 Claims, 1 Drawing Figure

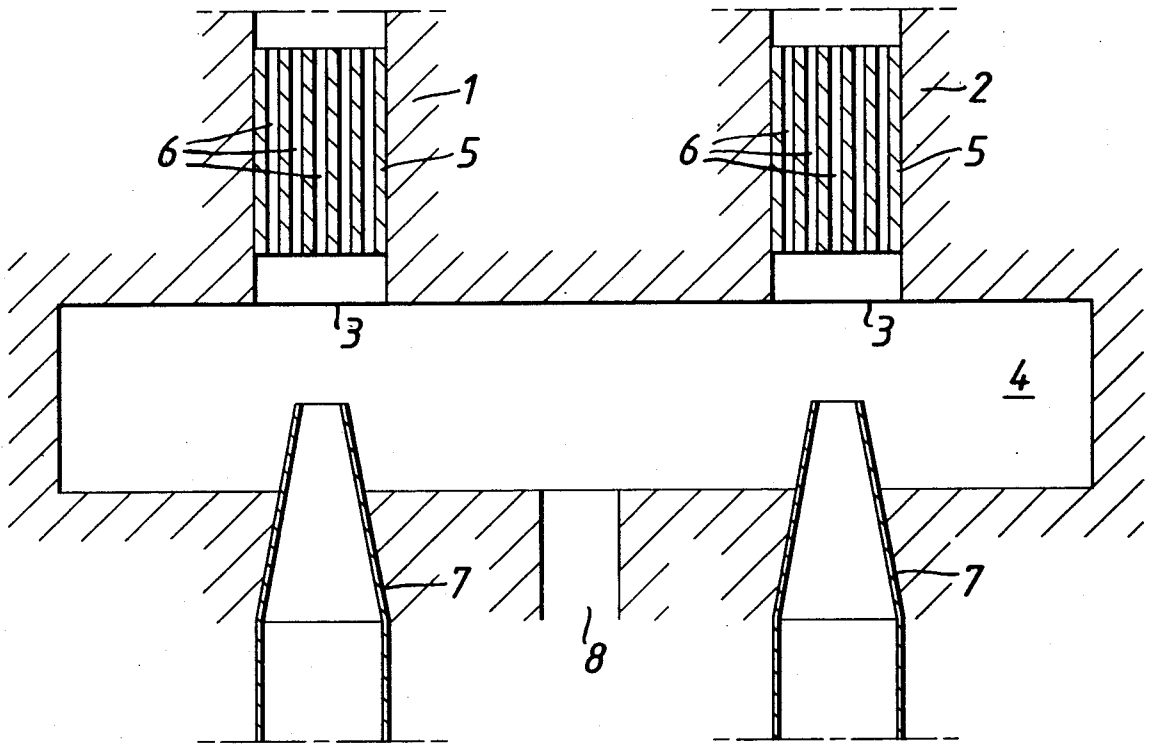
1
2
3
4
5
6
7
8

REGENERATIVE HEATING SYSTEMS

The present invention relates to a regenerative heating system including at least one pair of regenerators of the type which are operable so that while one is being heated by waste gas the other is heating air for the combustion of fuel.

According to the present invention we provide a regenerative heating system including at least one pair of regenerators of the type which are operable so that while one is being heated by hot gas the other is heating a cooler gas, the regenerators being interconnected adjacent one end to form a chamber having an outlet to discharge the hot gas flowing into the chamber from one of the regenerators, means extending into the chamber for injecting the cooler gas into the one end of each regenerator for heating in the regenerator before discharge through the opposite end of the regenerator.

Preferably means are provided to exert a suction force on the chamber outlet for withdrawal of the hot gas through the chamber outlet.

An embodiment of the invention will now be particularly described with reference to the accompanying drawing in which shows schematically the lower part of a regenerative heating system incorporating the features of the present invention.

Referring to the drawing, the system comprises a pair of regenerators 1 and 2, the lower ends 3 of which are connected by a manifold 4 forming a chamber for the discharge of waste gas from the regenerators 1 and 2. As conventional the regenerators 1 and 2 comprise shafts containing a bed 5 of permeable refractory heat absorbing material, the walls of the regenerators also being of refractory material. In use, during one cycle of operation hot gas eg. furnace waste gas travelling towards the beds 5 from the opposite ends (not shown) of the regenerators 1 and 2 passes through the beds by way of the channels 6 before discharge from the lower ends 3 of the regenerators 1 and 2. This causes the beds 5 to be heated. During the alternate cycle of operation, a cooler gas eg. air travelling upwards from the lower ends 3 of the regenerators 1 and 2 towards the opposite ends is heated by the pre-heated bed 5 as it passes through the channels. It will be appreciated that while waste gas is heating the bed of one regenerator, air is being heated by the bed of the other regenerator and the roles are reversed periodically.

Extending into the manifold 4 is a pair of air injector nozzles 7 for injecting air into each regenerator on alternate cycles. The air may be supplied as conventional by a compressor.

Located between the nozzles 7 is a waste gas outlet 8 forming a single offtake for each regenerator. An eductor or fan (not shown) may be provided to draw off the waste gas products discharging into the manifold 4 from the regenerator.

In use, while air is being injected into one regenerator by way of its nozzle, the other nozzle is switched off. After a preset period, the other nozzle is switched on and the first nozzle is switched off.

The roles are reversed periodically in this manner while the fan or eductor operates at all times.

Some of the waste gas will be entrained by the injected air entering the regenerator. The final effect of this is to reduce the flame temperature and therefore to reduce the production of the oxides of nitrogen (NOX). The amount of entrained combustion products may be varied and this gives a useful control of the production of NOX.

As conventional each regenerator may be provided with a burner at its other end by means of which fuel injected into the regenerator can be admixed with and combusted with the heated air before discharge from the regenerator. The regenerators may be connected to a furnace or the like to provide combusted fuel therefor, the waste combustion products returning from the furnace to the regenerators.

The injected air serves to prevent flue gas return as well as providing preheated air for combustion of the fuel.

This system eliminates the need for the conventional mechanical change-over valve by means of which the roles of the regenerators are periodically reversed.

The system may be used as a recirculator whereby hot waste gas issuing from one region of a furnace is caused to enter another region of the furnace after passage through the regenerators.

We claim:

1. A regenerative heating system including at least one pair of regenerators of the type which are operable so that while one is being heated by hot gas the other is heating a cooler gas, the regenerators being interconnected adjacent one end to form a chamber continuously communicating with both of said regenerators and having an outlet to discharge the hot gas flowing into the chamber from one of the regenerators, there being for each regenerator means extending into the chamber for injecting the cooler gas into one end of each regenerator for heating in the regenerator before discharge through the opposite end of the regenerator, the arrangement being such that only one cooler gas injecting means operates at any one time.

2. A system as claimed in claim 1 in which means are provided to exert a suction force on the chamber outlet for withdrawal of the waste gas through the chamber outlet.

3. A system as claimed in claim 1 in which each injection means comprises a nozzle having an outlet end facing the one end of each regenerator.

* * * * *